US006196022B1

(12) United States Patent
Horst et al.

(10) Patent No.: US 6,196,022 B1
(45) Date of Patent: Mar. 6, 2001

(54) PROCESS AND DEVICE FOR RECOVERING HIGH-PURITY OXYGEN

(75) Inventors: Corduan Horst, Puchheim; Rottmann Dietrich, Munich, both of (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/302,443

(22) Filed: Apr. 30, 1999

(30) Foreign Application Priority Data

Apr. 30, 1998 (DE) ..... 198 19 338

(51) Int. Cl.[7] ..... F25J 3/00
(52) U.S. Cl. ..... 62/643
(58) Field of Search ..... 62/643, 646, 647, 62/652, 656

(56) References Cited

U.S. PATENT DOCUMENTS

| | | | | |
|---|---|---|---|---|
| 4,303,428 | | 12/1981 | Vandenbussche | 62/13 |
| 5,123,947 | | 6/1992 | Agrawal | 62/27 |
| 5,471,842 | * | 12/1995 | Mostello et al. | 62/647 |
| 5,582,032 | * | 12/1996 | Shelton et al. | 62/643 |
| 5,963,666 | * | 11/1999 | Straub et al. | 62/643 |

FOREIGN PATENT DOCUMENTS

| | | |
|---|---|---|
| 3528374 | 2/1987 | (DE) . |
| 2655137 | 5/1991 | (FR) . |
| 9819122 | 5/1998 | (WO) . |

* cited by examiner

*Primary Examiner*—William Doerrler
(74) *Attorney, Agent, or Firm*—Millen, White, Zelano & Branigan, P.C.

(57) ABSTRACT

For recovering high-purity oxygen by low-temperature separation of air in a rectification system that has a high pressure (4) and a low-pressure column (5), feed air (1, 3) is introduced into the high pressure column (4) and an oxygen-containing liquid fraction (411) is removed from high pressure column (4) and fed into low-pressure column (5). Gaseous nitrogen (18) from the low-pressure column (5) is at least partially condensed in a top condenser (17) by indirect heat exchange with an evaporating liquid (457). Oxygen-containing liquid fraction (411) is removed from at least one theoretical or actual plate above the bottom of high pressure column (4). At least a portion of the bottom liquid (457) from the high pressure column (4) is directed into the evaporation chamber of the top condenser (17) of the low-pressure column (5). A high-purity oxygen product (459, 460, 461, 563, 564) is removed from the lower part of the low-pressure column (5).

13 Claims, 2 Drawing Sheets

PROCESS AND DEVICE FOR RECOVERING HIGH-PURITY OXYGEN

BACKGROUND OF THE INVENTION

The invention relates to a process for recovering high-purity oxygen by low-temperature separation of air in a rectification system having a high-pressure column and a low-pressure column, comprising introducing feed air into the high-pressure column, withdrawing an oxygen-containing liquid fraction from the high-pressure column and feeding said withdrawn fraction into the low-pressure column and passing gaseous nitrogen from the low-pressure column to a top condenser having a condensing side and an evaporating side in indirect heat exchange with an evaporating liquid in said evaporation side, so as to at least partially condense said gaseous nitrogen.

A process with these steps is known from DE 3528374 A1. In this two-column process, the low-pressure column has a top condenser in which gaseous top nitrogen is condensed and is recycled as reflux to the low-pressure column. This type of reflux production for the low-pressure column permits the withdrawal of a portion of the nitrogen produced in the double column as a pressurized product. The oxygen-concentrated liquid that accumulates as a bottom product in the low-pressure column is directed entirely to the evaporation side of the top condenser of the low-pressure column and is withdrawn as residual gas.

SUMMARY OF THE INVENTION

An object of the invention is to provide a process and apparatus to recover a high-purity oxygen product, as well as a pressurized nitrogen product, in a modified process of the above-mentioned type.

Upon further study of the specification to appended claims, the objects and advantages of the invention will become apparent.

These objects are achieved in that (A) the oxygen-containing liquid fraction that is fed to the low-pressure column is removed from at least one theoretical or actual plate above the bottom of the high pressure column, in that (B) the bottom liquid from the high pressure column is directed into the evaporation chamber of the top condenser of the low-pressure column, and in that (C) a high-purity oxygen is removed from the lower area of the low-pressure column.

In the production of high-purity oxygen, the reduction of nitrogen and argon contents in the oxygen product is relatively uncritical since it can be achieved by a correspondingly large number of plates in the lower section of the low-pressure column. These conventional measures do not, however, keep all less volatile contaminants from collecting in the oxygen product, i.e., air components having boiling points higher than oxygen and which were not removed by pre-cleaning the air upstream of the rectification system. Such less volatile air components include, for example, krypton, xenon, and hydrocarbons. It is also known to remove such contaminants in one or more subsequent rectification steps (see, for example, EP-299364-B1).

The process according to the present invention makes it unnecessary to employ additional rectification columns and uses the lower part of the high pressure column or an additional mass transfer section in the lower part of the high pressure column to separate the less volatile contaminants. The oxygen-containing liquid fraction that is directed into the low-pressure column is not removed from the bottom of the high pressure column, but rather from an intermediate point that is located above the bottom, especially above the air feed point into the high pressure column. Between the feedpoint and the intermediate point is located a mass transfer section comprising at least one theoretical or actual plate. This section preferably comprises 1 to 10, preferably 2 to 5 theoretical or actual plates, which are arranged between the air feed or the high pressure column bottom, on the one hand, and the point of removal of the oxygen-containing liquid fraction, on the other. (If, in this section, only actual plates are used as mass transfer elements, the data apply to actual plate numbers; if packing and filling materials or combinations of various types of mass transfer elements are used, the data can be used as theoretical plate numbers.)

By drawing off the feedstock for the low pressure column above the air feed, less volatile components of air such as hydrocarbons, krypton, and xenon are kept away from the low-pressure column. At the bottom of the column, a high-purity oxygen product is removed (total purity 99.5 to 99.999 vol %, preferably 99.8 to 99.999 vol %; proportion of less volatile components: 1 to 10 ppm, preferably 3 to 5 ppm). The high-purity oxygen can be drawn off in liquid and/or gaseous form directly at the bottom of the low-pressure column.

In the process according to the invention, the operating pressures of the columns can be, for example, 6 to 20, preferably 7 to 16 bar in the high pressure column and, for example, 3 to 8, preferably 3 to 6 bar in the low-pressure column.

The top condenser of the low-pressure column is operated at least in part with bottom liquid from the high pressure column as a refrigerant. Reflux for the high pressure column is usually produced by a condenser-evaporator via which the top of the high pressure column and the bottom of the low-pressure column are connected in heat exchange.

Especially for removing argon, a residual fraction can be removed from an intermediate point on the low-pressure column. This residual fraction, preferably an impure nitrogen fraction containing argon, is removed above the point where the oxygen-enriched liquid fraction is fed into the high pressure column.

Process cold can be produced by engine expansion pressure reduction of one or more of the following fractions:

- Residual gas from the evaporation chamber of the top condenser of the low-pressure column
- Vapor from the middle range of the low-pressure column (for example, the above-mentioned residual fraction)
- Partial current of the volume of feed air
- Nitrogen from the high pressure column or from the low-pressure column.

In the case of engine expansion pressure reduction of air, the turbine waste gas is fed preferably to the high pressure column or removed from the process, for example by being mixed with another residual current. In any case, the engine expanded air must not be fed to the low-pressure column since this would result in renewed contamination by less volatile components.

Using internal compression, the high-purity oxygen product can be bought to a pressure that is higher than the low-pressure column pressure, by having at least a portion of the oxygen product withdrawn in liquid form from the low-pressure column and evaporated under a pressure that is higher than the operating pressure of the low-pressure column. As a heating agent during evaporation, for example, correspondingly highly compressed air can be used.

To recover pressurized nitrogen, it is advantageous if a nitrogen fraction is removed in liquid form from the low-pressure column or its top condenser and the pressure of the nitrogen fraction in liquid state is increased to a value that is higher than the operating pressure of the low-pressure column. In this way—optionally in addition to direct removal of nitrogen from the high pressure column—gaseous nitrogen can be obtained under a pressure that is higher than the operating pressure of the low-pressure column. The liquid nitrogen that is pressurized can be returned to the high pressure column or evaporated in indirect heat exchange while bypassing the high pressure column.

If this pressurized nitrogen is to be obtained in especially high purity, the nitrogen fraction is removed from at least one theoretical or actual plate below the top of the low-pressure column, and at least a portion of the liquid nitrogen fraction is evaporated by indirect heat exchange under a pressure that is higher than the operating pressure of the low-pressure column and is withdrawn as a high-purity pressurized nitrogen product. As a heating agent in the case of indirect heat exchange, for example, a gas from the upper area of the high pressure column and/or a gas from the lower area of the low-pressure column can be used. Further details of this heat exchange step are described in Patent Applications DE 19735154 and WO 98/19122. High-purity pressurized nitrogen is defined as, for example, nitrogen with a total contamination of 1 ppm or less, especially between 1 ppm and $10^{-3}$ ppb and under a superatmospheric pressure, especially of over 3 bar.

The section of the low-pressure column that is located above the removal point of the nitrogen fraction is used to separate highly volatile contaminants. This section can be made up of packing or filling materials whose mass transfer action corresponds to at least one theoretical plate, or it can be made up of one or more conventional rectification plates, for example, sieve plates. Said section can consist of up to 10, preferably 2 to 5 theoretical or actual plates. The highly volatile contaminants are drawn off as a residual gaseous fraction from the liquefaction chamber of the top condenser of the low-pressure column.

To achieve the especially high purity of the nitrogen fraction from the low-pressure column, the latter is not introduced into the high pressure column, but rather is evaporated by indirect heat exchange and removed in unaltered concentration as a high-purity pressurized nitrogen product. The evaporation of the liquid pressurized nitrogen can be carried out by indirect heat exchange, as described above.

If a portion of the nitrogen that is recovered in the high pressure column is used as reflux for the low-pressure column, this quantity of nitrogen is usually drawn off at the top of the high pressure column. By having a liquid crude-nitrogen fraction be removed from the high pressure column from at least one theoretical or actual plate base below the top and passed to a point of the low-pressure column at least one theoretical or actual plate above the point of removal of the liquid nitrogen fraction, the high pressure column can easily be used to separate highly volatile contaminants. This provides advantages for the purity of the high-purity pressurized nitrogen product.

The invention also provides apparatus for recovering high-purity oxygen by low-temperature separation of air in a rectification system, comprising a high pressure column (4) and a low-pressure column (5), with a air line (3) for feed air which leads into high pressure column (4), a crude oxygen line (411) for introducing an oxygen-containing liquid faction from high pressure column (4) into low-pressure column (5) and with a top condenser having an evaporating side and a condensing side (17) for at least partial condensation of gaseous nitrogen (18) from low-pressure column (5) by indirect heat exchange with an evaporating liquid (457), characterized by a mass transfer section (458), arranged in the high pressure column (4) below the crude oxygen line (411) and above the feed air line (3), said section having at least one theoretical or actual plate, a liquid line (457) for introducing the bottom liquid from high pressure column (4) into the evaporating side of the top condenser (17) of the low-pressure column (5) and a line for removal of high-purity oxygen product (459, 460, 461, 563, 564) from the lower part of low-pressure column (5).

DETAILED DESCRIPTION OF THE DRAWINGS

Figure 1:
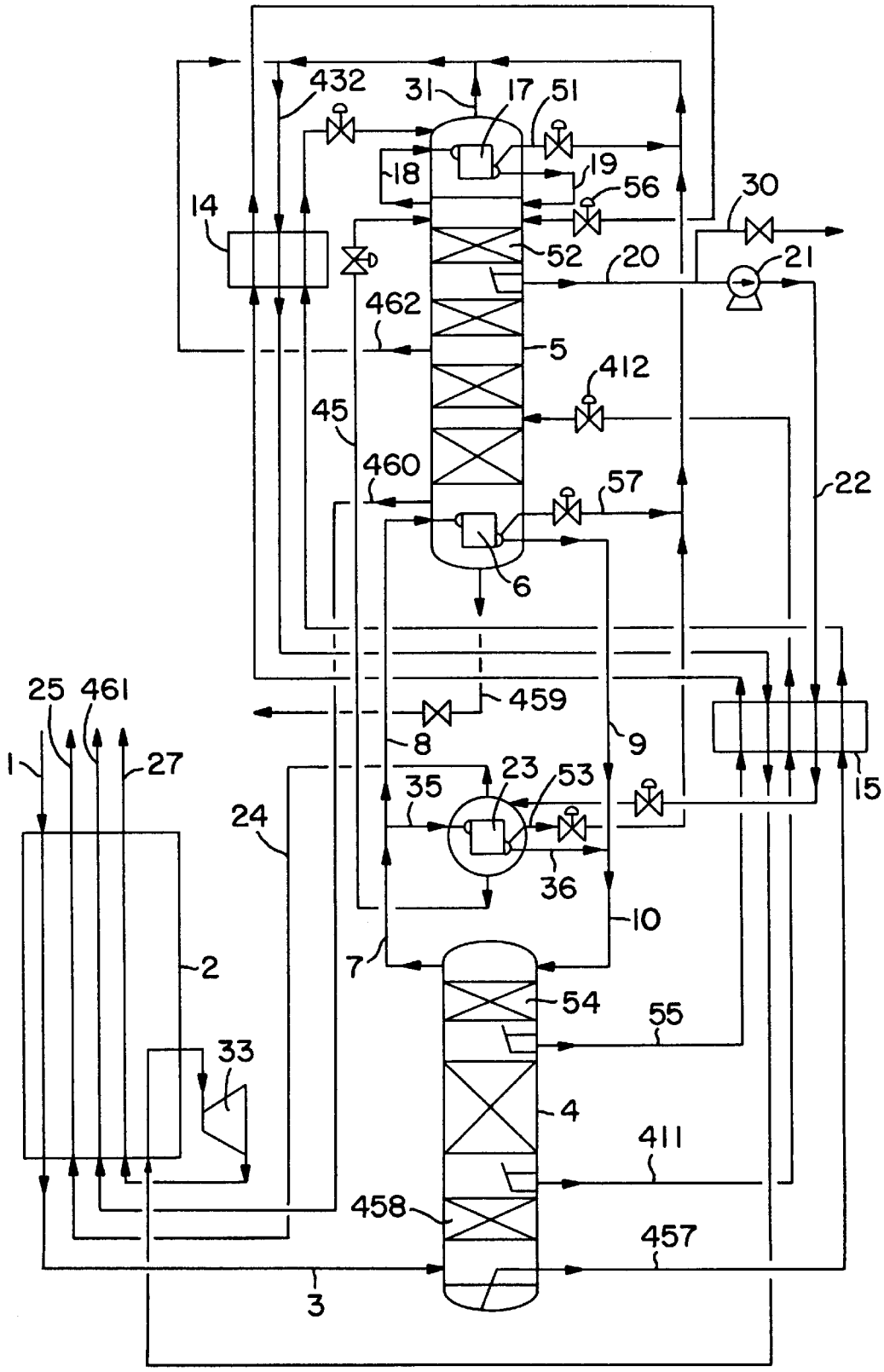
FIG. 1 shows a first embodiment of the invention with gaseous and/or liquid removal of the high-purity oxygen product from the low-pressure column and FIG. 2 shows a second embodiment with internal compression of the oxygen product.

In the process of FIG. 1, compressed and purified air 1 is cooled in a main heat exchanger 2 and fed to a high pressure column 4 under a pressure of 14 bar (3). In addition, the rectification system has a low-pressure column 5, which is operated at a pressure of 5 bar and forms a heat-exchange connection with the high pressure column via a common condenser-evaporator (main condenser) 6. A portion 8 of nitrogen 7 that is removed at the top of the high pressure column is liquefied in main condenser 6 and is used as reflux in the high pressure column via lines 9 and 10. Via line 57, a residual vapor that contains highly volatile contaminants such as helium, neon, and/or hydrogen can be removed from the main condenser 6. An oxygen-containing liquid fraction 411 from the high pressure column is throttled (412), after subcooling 15, into the low-pressure column 5.

Low-pressure column 5 has a top condenser 17, in whose liquefaction chamber gaseous nitrogen 18 from the top of low-pressure column 5 is condensed; condensate 19 is returned at least partially to the low-pressure column. A residual vapor that contains especially highly volatile contaminants such as helium, neon, and/or hydrogen is removed at 51 from top condenser 17 (as depicted) or alternatively from fraction 19 which is condensed in the top condenser.

According to the invention, top condenser 17 of low-pressure column 5 is not or is not exclusively operated with bottom liquid from the low-pressure column (see prior art according to DE 3528374 A1), but rather with bottom liquid 457 from high pressure column 4. Oxygen-containing liquid fraction 411, generally being enriched in oxygen as compared to air originating from an intermediate point above an additional mass transfer section 458 in the lower area of the high pressure column, is throttled (412) into the low-pressure column 5. In this example, the additional mass transfer section 458 has five theoretical plates. (The mass transfer section can also be called a distillation section.) In the bottom of low-pressure column 5, a high-purity oxygen product with a purity of 99.99 vol % is produced and drawn off in liquid form (459) and/or in gaseous form (460, 461) at the pressure of the low-pressure column. Via a residual fraction (impure nitrogen fraction) 462, argon is removed from low-pressure column 5. The impure nitrogen is preferably combined with other residual streams 31, 57, 51, and 53.

In addition, the embodiment is used to recover high-purity pressurized nitrogen. A portion of the liquid that flows into high pressure column 4 is removed as crude-nitrogen fraction 55 below a mass transfer section 54, which has three theoretical plates in the example and is throttled (56) at the top of low-pressure column 5.

After passing through a mass transfer section 52, which has three theoretical plates in the example, a portion of the liquid that flows into low-pressure column 5 is removed as a nitrogen fraction 20, pressurized (pump 21) into the liquid state (for example, 14 bar), and sent via line 22 through subcooler 15 to a product evaporator 23. Nitrogen 24 that is evaporated under a pressure of 13.4 bar is heated in main heat exchanger 2 and is withdrawn as a high-purity pressurized product 25. It can optionally be further compressed in the gaseous state. In the example, high-purity pressurized nitrogen product 25 has an overall contamination of 10 ppb (including carbon monoxide). If required, a portion of gaseous nitrogen 7 from the top of the high pressure column can be heated in main heat exchanger 2 and recovered as another pressurized product of lower purity (not depicted). In this case, it is possible to eliminate the passage of liquid nitrogen 55 from high pressure column 4 into low-pressure column 5.

A (another) portion 35 of gaseous nitrogen 7 from the top of high pressure column 4 is condensed on the liquefaction side of product evaporator 23. The resultant liquid 36 is used in high pressure column 4 as additional reflux. Product evaporator 23 is provided as a falling-film evaporator in the example, in which only partial evaporation occurs. Nitrogen 45 that remains liquid is returned to low-pressure column 5. Also in product evaporator 23, a residual vapor that contains highly volatile contaminants such as helium, neon, and/or hydrogen is removed (line 53).

If required, a portion of liquid nitrogen fraction 20 can be recovered as liquid product 30 from the low-pressure column. Impure oxygen 31, which forms by evaporation of bottom liquid 457 from high pressure column 5 in top condenser 17 of the low-pressure column, is heated via residual gas line 432 in heat exchangers 14, 15, and 2 and is released as a by-product or as residual gas (27). It can be used, for example, for the regeneration of an upstream system for air purification.

In the process according to FIG. 1, cold production is provided by engine expansion pressure reduction 33 of residual gases 432. The mechanical energy that is recovered in the depressurization turbine 33 can be used, for example, for secondary compression of pressurized nitrogen product 24 that is evaporated in product evaporator 23 or to increase the pressure in the residual gas upstream from depressurization machine 33, preferably by direct mechanical coupling of turbine 33 and a corresponding compressor. It is advantageous if residual vapors 57, 51, and 53 also are added to the residual gas line 432.

Especially in the case of a relatively high demand for liquid product 30, an air turbine can be used in addition to or as an alternative to the residual gas turbine that is depicted in FIG. 1. In this case, a portion of compressed and purified air 1 is cooled in main heat exchanger 2 to only an intermediate temperature and is then subjected to engine expansion. The depressurized air can be heated and returned in front of the air compressor. The mechanical energy that is produced in the air turbine can be used for secondary compression of the air from the engine expansion.

Figure 2:
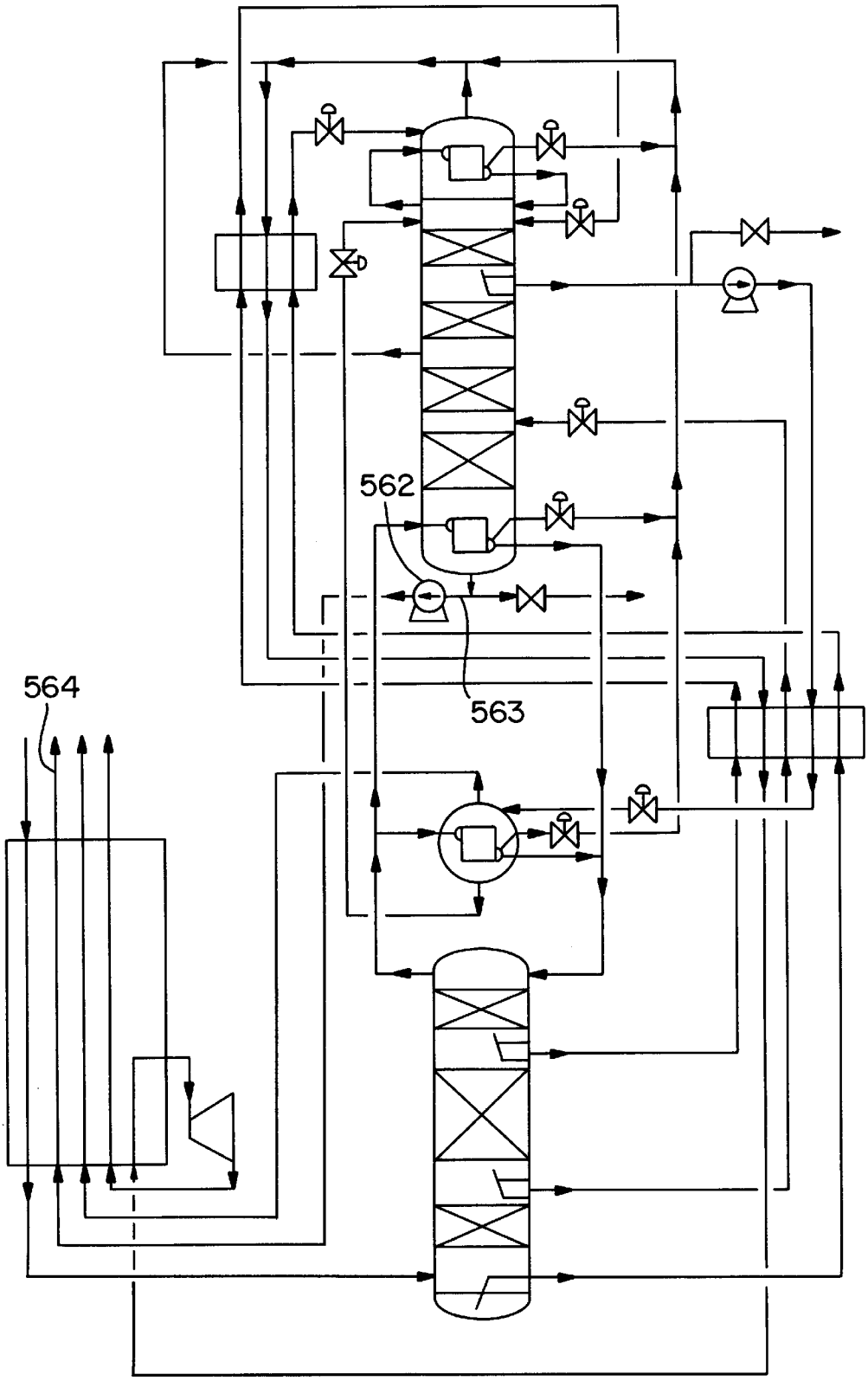

If it is desired to produce high-purity oxygen product under a pressure higher than the operating pressure of the low-pressure column, the high-purity oxygen that is drawn off in the liquid state from the low-pressure column can be increased in pressure in a liquid pump 562, and can then be evaporated by indirect heat exchange against feed air in a product evaporator. In the example of FIG. 2, main heat exchanger 2 is used as a product evaporator for the high-purity oxygen; as an alternative, a separate product evaporator could be provided. After (another) heating in main heat exchanger 2, the pressurized oxygen product is drawn off at 564.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 19819338.6, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for recovering high-purity oxygen by low-temperature separation of air in a rectification system having a high pressure column (4) and a low-pressure column (5), said process comprising:

introducing a volume of feed air (1, 3) into high pressure column (4), withdrawing an oxygen-containing liquid fraction (411) from the high pressure column (4) and feeding said withdrawn fraction into the low-pressure column (5) and passing gaseous nitrogen (18) from the low-pressure column (5) to the condensation side of a top condenser (17), having an evaporation side and a condensation side (457), so as to at least partially condense said gaseous nitrogen by indirect heat exchange with an evaporating liquid, wherein the oxygen-containing liquid fraction (411), is withdrawn from at least one theoretical or actual plate above the bottom of high pressure column (4), and is then fed at a feedpoint into the low-pressure column (5), at least a portion of bottom liquid (457) from high pressure column (4) is passed into the evaporation side of the top condenser (17) of the low-pressure column (5), and a high-purity oxygen product (459, 460, 461, 563, 564) is withdrawn from the low-pressure column (5) at a point below the feedpoint of said oxygen containing liquid fraction (411).

2. A process according to claim 1, wherein an impure nitrogen fraction (462) is drawn off from an intermediate point of the low-pressure column.

3. Process according to claim 1, wherein a gaseous fraction (31) from the evaporation chamber of top condenser (17) of the low-pressure column a gaseous fraction (462) from the low-pressure column, or both, are subjected to pressure reduction 33.

4. Process according to claim 1, wherein a portion of cool air is subjected to pressure reduction.

5. A process according to claim 1, wherein at least a portion (563) of the high-purity oxygen product is removed in a liquid state from low-pressure column (5) and evaporated (2) under a pressure that is higher than the operating pressure of low-pressure column (5).

6. A process according to claim 1, wherein a nitrogen fraction (20) is removed in a liquid state from low-pressure column (5) or its top condenser (17), and the pressure of nitrogen fraction (20) is increased in the liquid state to a value that is higher than the operating pressure of low-pressure column (5).

7. A process for recovering a high-purity oxygen by low-temperature separation of air in a rectification system having a high-pressure column (4) and a low-pressure column (5), said process comprising:

introducing a volume of feed air (1,3) into high-pressure column (4), withdrawing an oxygen-containing liquid fraction (411) from the high-pressure column (4) and feeding said withdrawn fraction into the low-pressure column (5) and passing gaseous nitrogen (18) from the low-pressure column (5) to the condensation side of a top condenser (17), having an evaporation side and a condensation side (457), so as to at least partially condense said gaseous nitrogen by indirect heat exchange with an evaporating liquid, wherein the oxygen-containing liquid fraction (411), is withdrawn from at least one theoretical or actual plate above the bottom of high-pressure column (4), and is then fed at a feedpoint into the low-pressure column (5), at least a portion of bottom liquid (457) from high-pressure column (4) is passed into the evaporating side of the top condenser (17) of the low-pressure column (5), and a high-purity oxygen product (459, 460, 461, 563, 564) is withdrawn from the low-pressure column (5) at a point below the feedpoint of said oxygen containing liquid fraction (411), and removing a nitrogen fraction (20) in a liquid state from low-pressure column (5) or top condenser (17), and the pressure of nitrogen fraction (20) is increased in the liquid state to a value that is higher than the operating pressure of low-pressure column (5), wherein liquid nitrogen fraction (20) is removed at least one theoretical or actual plate below the top of the low-pressure column, and at least a portion of liquid nitrogen fraction (22) is evaporated under a pressure that is higher than the operating pressure of low-pressure column (5) by indirect heat exchange (23) and is removed as a high-purity pressurized nitrogen product (24, 25).

8. A process for recovering high-purity oxygen by low-temperature separation of air in a rectification system having a column (4) and a low-pressure column (5), said process comprising:

introducing a volume of feed air (1, 3) into pressurized column (4), withdrawing an oxygen-containing liquid fraction (411) from the pressurized column (4) and feeding said withdrawn fraction into the low-pressure column (5) and passing gaseous nitrogen (18) from the low-pressure column (5) to the evaporating side of a top condenser (17), having an evaporation side and a condensation side (457), so as to at least partially condense said gaseous nitrogen by indirect beat exchange with an evaporating liquid, wherein the oxygen-containing liquid fraction (411), is withdrawn from at least one theoretical or actual plate above the bottom of pressurized column (4), and is then fed at a feedpoint into the low-pressure column (5), at least a portion of bottom liquid (457) from pressurized column (4) is passed into the evaporating side of the top condenser (17) of the low-pressure column (5), and a high-purity oxygen product (459, 460, 461, 563, 564) is withdrawn from the low-pressure column (5) at a point below the feedpoint of said oxygen containing liquid fraction (411), wherein a liquid crude-nitrogen fraction (55) is removed from high pressure column (4) in at least one theoretical or at least one actual plate below the top and is passed to a point of the low-pressure column (5) that lies at least one theoretical or actual plate above the point of removal of the liquid nitrogen fraction (20).

9. An apparatus for recovering high-purity oxygen by low-temperature separation of air comprising a rectification system, having a high pressure column (4) and a low-pressure column (5), an air line (3) for feed air which leads into high pressure column (4), a crude oxygen line (411) for introducing an oxygen-containing liquid fraction from high pressure (4) into low-pressure column (5), a top condenser having an evaporating side and a condensing side (17) for at least partial condensation of gaseous nitrogen (18) from the low-pressure column (5) by indirect heat exchange with an evaporating liquid (457), the improvement comprising providing a mass transfer section (458), arranged in the high pressure column (4) below the crude oxygen line (411) and above the feed air line (3), said mass transfer section having at least one theoretical or actual plate, a liquid line (457) for introducing the bottom liquid from high pressure column (4) into the evaporating side of the top condenser (17) of the low-pressure column (5), and a line for removal of high-purity oxygen product (459, 460, 461, 563, 564) from the lower part of low-pressure column (5).

10. Apparatus according to claim 9, further comprising a line for removal of an impure nitrogen fraction (462, 432) connected to an intermediate point of low-pressure column (5).

11. A process according to claim 1, wherein the high pressure column (4) operates at a pressure of 6–20 bar and the low pressure column (5) operates at a pressure of 3–8 bar.

12. A process according to claim 1, wherein a gaseous nitrogen stream (18) is removed from the top of the lower pressure column (5) and condensed in top condenser (17), and the resultant condensate (19) is, at least partially, returned to the top of low pressure column (5) as reflux.

13. A process according to claim 1, wherein a liquid nitrogen fraction (20) is removed from low pressure column (5), pressurized and evaporated by heat exchange with an overhead stream from the high pressure column (4).

* * * * *